US006837797B2

(12) United States Patent
Hull

(10) Patent No.: US 6,837,797 B2
(45) Date of Patent: Jan. 4, 2005

(54) GREAT PUTTING GAME

(76) Inventor: Judith S. Hull, 1322 Hoover Ave., Eau Claire, WI (US) 54701-4267

( * ) Notice: Subject to any disclaimer, the term of this patent is extended or adjusted under 35 U.S.C. 154(b) by 0 days.

(21) Appl. No.: 10/720,052

(22) Filed: Nov. 24, 2003

(65) Prior Publication Data

US 2004/0219986 A1 Nov. 4, 2004

Related U.S. Application Data

(60) Provisional application No. 60/466,343, filed on Apr. 30, 2003.

(51) Int. Cl.[7] ..... A63B 69/36

(52) U.S. Cl. ..... 473/150; 473/159; 473/171; 473/409; 473/175

(58) Field of Search ..... 473/131, 150–196, 473/409

(56) References Cited

U.S. PATENT DOCUMENTS

| | | | | | |
|---|---|---|---|---|---|
| 1,738,265 | A | * | 12/1929 | Scanlan | 273/123 R |
| 3,584,877 | A | | 6/1971 | Florian | |
| 3,722,889 | A | * | 3/1973 | Miller | 473/169 |
| 3,843,136 | A | * | 10/1974 | Buenzle | 473/162 |
| 3,876,210 | A | | 4/1975 | Brandell | |
| 4,327,917 | A | | 5/1982 | Bagley | |
| 4,743,026 | A | * | 5/1988 | Eady | 473/162 |
| 4,877,250 | A | * | 10/1989 | Centafanti | 473/157 |
| 4,934,704 | A | * | 6/1990 | Mazer | 473/158 |
| 5,108,101 | A | | 4/1992 | Postula | |
| 5,203,566 | A | * | 4/1993 | Ricigliano | 473/158 |
| 5,316,302 | A | * | 5/1994 | Sedberry | 473/185 |
| 5,419,561 | A | * | 5/1995 | Weber | 473/409 |
| 5,435,560 | A | * | 7/1995 | Kehoe | 473/180 |
| 5,573,247 | A | | 11/1996 | Ridge | |
| 5,607,360 | A | | 3/1997 | Shiffman | |
| 5,954,590 | A | | 9/1999 | Nixey | |
| 6,241,621 | B1 | * | 6/2001 | Maher | 473/185 |
| 6,248,022 | B1 | * | 6/2001 | Steyn | 473/162 |
| 6,419,590 | B1 | | 7/2002 | Criger | |
| 6,575,841 | B1 | * | 6/2003 | Erdoes et al. | 473/160 |
| 2003/0160387 | A1 | * | 8/2003 | Drury | 273/245 |
| 2003/0211899 | A1 | * | 11/2003 | Fleming | 473/173 |

* cited by examiner

*Primary Examiner*—Mark S. Graham
(74) *Attorney, Agent, or Firm*—Tipton L. Randall

(57) ABSTRACT

A method for playing a putting game on a golf green surface is disclosed. Each player is provided a like plurality of golf balls, each ball having a unique feature for association with one player. In each round, all balls are placed on the circumference of a circle of a selected radius, with the cup at the circle center. Each player putts the balls having that player's associated unique feature until each ball enters the cup or each ball is putted twice. All balls failing to enter the cup in two putts are removed from play after the second putt. A score value is provided to each player for each ball remaining in play at the end of the round. In each subsequent round, the above steps are repeated with each circle radius greater than the prior circle radius, until all balls are out of play. The score value for each player is totaled to determine a winner.

22 Claims, 2 Drawing Sheets

The Great Putting Game™ Player Susan Date 6/25/2003

| Distance | No. of balls holed-out in 1 | Points | Score | No. of balls holed-out in 2 | Points | Score | Subtotal | Total |
|---|---|---|---|---|---|---|---|---|
| 2.5' | 4 | 5 | 20 | 1 | 1 | 1 | 21 | 21 |
| 5' | 3 | 10 | 30 | 2 | 5 | 10 | 40 | 61 |
| 7' | 3 | 20 | 60 | 2 | 10 | 20 | 80 | 141 |
| 8' | 2 | 30 | 60 | 2 | 15 | 30 | 90 | 231 |
| 10' | 2 | 40 | 80 | 2 | 20 | 40 | 120 | 351 |
| 11' | 1 | 50 | 50 | 2 | 25 | 50 | 100 | 451 |
| 12' | --- | 60 | 0 | 2 | 30 | 60 | 60 | 511 |
| 15' | 1 | 70 | 70 | 1 | 35 | 35 | 105 | 616 |
| 18' | --- | 80 | 0 | 1 | 40 | 40 | 40 | 656 |
| 20' | --- | 90 | 0 | 1 | 45 | 45 | 45 | 701 |
| 25' | --- | 100 | 0 | --- | 50 | 0 | 0 | 701 |
| 30' | | 150 | | | 75 | | | |

The Great Putting Game™ Player Susan Date 6/25/2003

| Distance | No. of balls holed-out in 1 | Points | Score | No. of balls holed-out in 2 | Points | Score | Subtotal | Total |
|---|---|---|---|---|---|---|---|---|
| 2.5' | 4 | 5 | 20 | 1 | 1 | 1 | 21 | 21 |
| 5' | 3 | 10 | 30 | 2 | 5 | 10 | 40 | 61 |
| 7' | 3 | 20 | 60 | 2 | 10 | 20 | 80 | 141 |
| 8' | 2 | 30 | 60 | 2 | 15 | 30 | 90 | 231 |
| 10' | 2 | 40 | 80 | 2 | 20 | 40 | 120 | 351 |
| 11' | 1 | 50 | 50 | 2 | 25 | 50 | 100 | 451 |
| 12' | --- | 60 | 0 | 2 | 30 | 60 | 60 | 511 |
| 15' | 1 | 70 | 70 | 1 | 35 | 35 | 105 | 616 |
| 18' | --- | 80 | 0 | 1 | 40 | 40 | 40 | 656 |
| 20' | --- | 90 | 0 | 1 | 45 | 45 | 45 | 701 |
| 25' | --- | 100 | 0 | --- | 50 | 0 | 0 | 701 |
| 30' | | 150 | | | 75 | | | |

Figure 1

The Great Putting Game™ Player James Date 6/25/2003

| Distance | No. of balls holed-out in 1 | Points | Score | No. of balls holed-out in 2 | Points | Score | Subtotal | Total |
|---|---|---|---|---|---|---|---|---|
| 2.5' | 5 | 5 | 25 | --- | 1 | 0 | 25 | 25 |
| 5' | 4 | 10 | 40 | 1 | 5 | 5 | 45 | 70 |
| 7' | --- | 20 | 0 | 4 | 10 | 40 | 40 | 110 |
| 8' | 2 | 30 | 60 | 2 | 15 | 30 | 90 | 200 |
| 10' | 2 | 40 | 80 | 2 | 20 | 40 | 120 | 320 |
| 11' | --- | 50 | 0 | 3 | 25 | 75 | 75 | 395 |
| 12' | 1 | 60 | 60 | 2 | 30 | 60 | 120 | 515 |
| 15' | --- | 70 | 0 | 1 | 35 | 35 | 35 | 550 |
| 18' | 1 | 80 | 80 | --- | 40 | 0 | 80 | 630 |
| 20' | --- | 90 | 0 | 1 | 45 | 45 | 45 | 675 |
| 25' | --- | 100 | 0 | --- | 50 | 0 | 0 | 675 |
| 30' | | 150 | | | 75 | | | |

Figure 2

GREAT PUTTING GAME

CROSS-REFERENCE TO RELATED APPLICATIONS, IF ANY

This application claims the benefit under 35 U.S.C. §119 (e) of co-pending provisional application Ser. No. 60/466,343, filed 30 Apr., 2003. Application Ser. No. 60/466,343 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a golf game played on a putting green and, more particularly, a game designed to improve the golfer's skills in putting a ball on the putting green.

2. Background Information

The state of the art includes various games and devices providing putting practice for golfers. This technology is believed to have significant limitations and shortcomings, including, but not limited to, that the devices do not provide actual putting practice on a real green and are only marginally effective.

For this and other reasons, a need exists for the present invention. This invention provides a simple game with minimal required devices, which is believed to fulfill the need and to constitute an improvement over the background technology.

All United States patents and patent applications, and all other published documents mentioned anywhere in this application are incorporated by reference in their entirety. Some examples of putting practice games and devices for which patents have been granted include the following.

Florian, in U.S. Pat. No. 3,584,877, describes a portable golf game using a golf club and a ball and including a fabric runner simulating a golfing green and having an inclined portion at the end of the runner with the incline and runner having selected scoring areas. The scoring area on the incline is a centrally located ball receiving opening. The scoring area on the runner may be in the form of marks simulating a triangulated shuffleboard score area. The inclination of the incline is such that some balls traveling up the incline with inadequate momentum will reverse and roll down onto the scoring area on the runner. A vertical wall is provided beyond the upper end of the incline, to form a backboard.

In U.S. Pat. No. 3,876,210, Brandell discloses a golf putting game device which may be laid on a carpet, or the like, to afford a target onto which a golf ball may be putted. The game surface is convex upwardly and embodies a plurality of target areas onto which a ball may be putted from a position remote from the game. The target areas include "scoring" depressions toward which putts may be directed for the purpose of scoring positive points, and "hazard" formations, including "trap" depressions and "bunker" ridges for creating difficulties in putting into the "scoring" depressions and, possibly, causing the player to receive negative points.

Bagley, in U.S. Pat. No. 4,327,917, describes a golf putting game which includes a housing having a horizontally elongated opening into which a standard golf ball can be putted. Horizontally spaced sensors, positioned lengthwise of the opening within the housing, sense the lateral position of a ball entering the opening. The sensors control a numerical display indicating a score based on the position of the ball laterally of the opening. A back plate stops the ball within the housing, and a sensor determines the force with which the ball strikes the back plate. The indicated score is modified if the force on the back plate exceeds an acceptable level. Successive groups of balls can be putted into the opening, and the score for each ball within the corresponding ball in the successive groups can be accumulated and individually displayed to permit a number of players to play the game at the same time.

In U.S. Pat. No. 5,108,101, Postula discloses a golf putting game, played with regular golf balls and clubs on an elongated rectangular playing area. At the end of the playing area, distal the putting lines, is a shallow ramp. Several holes or depressions in the surface of the ramp, called "bunkers" in the game, act as ball traps. The playing area is conveniently made up in the form of a roll-up mat. The game itself has two phases. In phase one, the players attempt to putt balls into one of the bunkers to accumulate points. Phase two of the game has three embodiments, in all of which the players attempt to land their putts in one of the last three rectangles defined by the transverse lines to score. Bunker balls do not count in phase two. Score points are counted only at the end of a round of play in two of the embodiments, which encourages strategy and "bumping" of opponents' balls out of the score rectangles. The winning team is the first to reach a certain total score in two of the phase two embodiments, and is the team with the most points after eight rounds in the other.

Ridge, in U.S. Pat. No. 5,573,247, describes a putting game for playing a golfer's version of tic-tac-toe, with each player having a separate set of balls and with separate indentations on a game frame for storing the sets of balls.

In U.S. Pat. No. 5,607,360, Shiffman discloses a golf putting game apparatus for improving a player's putting skills. The golf putting game apparatus allows the player to practice putting accurately and to practice putting the ball with the correct amount of force. A scoring method for measuring the player's relative proficiency is provided. The golf putting game apparatus comprises a scoring template with opposite front and rear edges for arrangement on a putting surface such as a suitable carpet material, a putting green, or other surface suitable for putting. The scoring template includes hole marking means for marking on the putting surface a circular zone which represents a hole on a golf green, holed-out zone marking means for marking on the putting surface an elongated holed-out zone extending from the circular zone to the rear edge of the template, and scoring zone marking means for marking on the putting surface a pattern of spaced apart lines. The scoring zone marking means are spaced from and extend outwards from the circular zone to the edges of the template. A golf ball putt onto the template from in front of the template with the correct line and weight to enter a hole in a golf green will come to rest on the circular zone or holed-out zone. This allows the golfer to develop a feel for putting with the correct weight, as well as line. A score is calculated by adding scoring indices marked on the template which lie adjacent the location at which the ball comes to rest.

Nixey, in U.S. Pat. No. 5,954,590, describes a golf putting aid for use on a playing surface, including a plurality of polygon-shaped faces forming a hollow polyhedron, with at least two of the polygon-shaped faces each having a plurality of openings there through for receipt there through of a putted golf ball. Each of the at least two polygon-shaped faces may be placed flat against the playing surface, such that an opening in an adjacent one of the polygon-shaped faces is exposed for receipt there through of a putted golf ball.

In U.S. Pat. No. 6,419,590, Criger discloses a scoring overlay in the form of a target and a system for improving golf putting. The overlay is designed for use after a golf putt, to provide a score based on the position of the ball relative to the hole. The center of the overlay is placed over the hole on the golf green, and the overlay is oriented based on the direction from which the putt was made. A score is awarded based on the position of the ball on the overlay. Scores are based on how close the ball is to the hole. However, a higher score is awarded for a ball a given distance from the hole that was hit hard enough to reach or pass the hole than for a ball equally distant from the hole that was not hit hard enough to reach the hole. Similarly, lower scores are provided for golf balls hit off line from center, either far to the right or far to the left. The invention also includes a method for improving putting by a game using the overlay.

Applicant has devised a simple putting practice game with minimal required devices. The game of the present invention provides putting practice that is enjoyable for the player. The game can be played alone or by two or more players.

SUMMARY OF THE INVENTION

The invention is directed to a method for playing a putting game on a golf green surface, having at least one cup therein. The method comprises the steps of providing each player a like plurality of golf balls, each ball having a unique feature for association with one player. In a first round, all balls are placed on the circumference of a circle of a first radius, with the cup at the circle's center. Each player putts the balls having that player's associated unique feature until each ball enters the cup or is putted twice. All balls putted twice and not entering the cup are removed from play. A score value is provided to each player for each ball remaining in play. In a second round, all balls remaining in play are placed on the circumference of a circle of a second radius, greater than the first radius, with the cup at the circle's center. Each player putts the balls having that player's associated unique feature until each ball enters the cup or is putted twice. Again, all balls putted twice and not entering the cup are removed from play. A score value is provided to each player for each ball remaining in play. In each subsequent round, the above steps are repeated with each circle radius greater than the prior round's circle radius, until all balls are out of play. The score value for each player is totaled to determine a winner.

BRIEF DESCRIPTION OF THE DRAWINGS

FIG. 1 is an example scorecard for one player playing the game of the present invention.

FIG. 2 is an example scorecard for another player playing the game of the present invention.

DESCRIPTION OF THE EMBODIMENTS

The present invention is a game designed to improve the golfer's skills in putting a ball on the putting green. The game of the present invention simulates the mental demands of course play, can be played alone or with one or more friends, and is appropriate for all ages and skill levels of players.

The game of the present invention is preferably played on a golf course practice green, although any golf green can be used. An objective of the present invention is to make skill building fun. Skills are acquired through repetition, including repetition of the putting stroke, reading the green and experiencing pressure situations. The game improves both the mechanical and psychological skills required in playing golf.

Many players avoid concentrated effort on their "golf skills." Players want to play golf and have fun. The present invention provides such a concentrated effort to improve the player's putting skills. The player doesn't feel as though he/she is spending a lot of time working on skills. Yet, the player cannot help improving his/her skills. In playing the game of the present invention, the player reads the green repetitively, watches the opponent's putts roll repetitively, practices putting techniques and experiences pressure, repetitively. The enjoyable practice while playing the game of the present invention improves the player's golf game while providing fun and excitement.

Although the putting game of the present invention can be played alone, the method of the game is described for two players, although three or more players can participate equally well.

The present invention is directed to a method for playing a putting game on a golf green surface having at least one cup therein. Preferably, the game is played on a golf course practice green, which may have several cups, although any golf green can be used. The method comprises the steps of providing each player a like plurality of golf balls, each ball having a unique feature for association with one player. For example, each player receives a set of five (5) colored balls, each set of a different color. Alternatively, the unique feature of each ball in the set may be a particular distinctive marking, such as a number, a letter, or other symbol, the objective being to readily identify the balls associated with each player.

In a first round, all balls are placed on the circumference of a circle of a first radius with the cup at the circle center. The placement of the balls on the circle circumference is easily achieved by fastening a suitable measuring device, such as a color-coded tape measure, to the flag stick in the cup and moving the end of the tape opposite the flag stick around the cup. The first radius selected is preferably a short distance, for example 2.5 feet. With two or more players, the balls are placed evenly around the cup, and in alternating sequence on the circle circumference. For example, with two players, one with a set of green golf balls and the other with a set of yellow golf balls, the ball placement sequence is green, yellow, green, yellow, etc.

Each player putts the balls having that player's associated unique feature until each ball enters the cup or is putted twice. Preferably, with two or more players, the players putt in alternate sequence, in the order the balls are positioned on the circle circumference. Also preferably, each player putts one ball consecutively until the ball enters the cup or is putted twice. Play continues until all balls have entered the cup or has been putted twice.

All balls putted twice and not entering the cup are then removed from play after the second putt. A score value is provided to each player for each ball remaining in play at the end of the first round. The score value provided to each player for each ball remaining in play at the end of the round is positively correlated with the circle radius of each round, as described below.

In a second round, all balls remaining in play are placed on the circumference of a circle of a second radius, greater than the first radius, with the cup at the circle center. The placement of the balls on the circle circumference is achieved as, described above. The second radius selected is preferably a longer distance, for example 5.0 feet. With two or more players, the balls again are placed evenly around the cup, and in alternating sequence on the circle circumference, as described above. Each player putts the balls having that player's associated unique feature until each ball enters the cup or is putted twice. Preferably, with two or more players, the players putt in alternate sequence, in the order the balls are positioned on the circle circumference. Also preferably, each player putts one ball consecutively until the ball enters the cup or is putted twice. This may require one or two putts to roll a particular ball into the cup. Play continues until all balls have entered the cup or has been putted twice.

Again, all balls putted twice and not entering the cup are removed from play after the second putt. A score value is provided to each player for each ball remaining in play. The score value provided to each player for each ball remaining in play at the end of the round is positively correlated with the circle radius of each round. The score value for each ball remaining in play after starting from a larger radius circle is greater than the score value for each ball remaining in play after starting from a smaller radius circle. In addition, within a given round, balls entering the cup with one putt produce a greater score value than balls entering the cup with two putts.

In each subsequent round, the above steps are repeated with each circle radius greater than the prior round's circle radius, until all balls are out of play. The score value for each player is totaled to determine a winner. Example score cards for two competing players are shown in FIGS. 1 and 2, where each player starts the game with five (5) balls. It is important to realize that the player with the fewer balls toward the later rounds will not necessarily lose the game.

Although the method of playing the putting game has been described for two players, three or more players can participate within the sequence described above. Likewise, a single individual can play the game alone. The single player follows the method outlined above and obtains a final score at the end of the game. The single player can repeat the game, using the same number of balls and the same circle radii, and attempt to exceed the final score of the earlier played game.

Several further embodiments of the game are now described. In "Sudden Death," the players agree to the "Sudden Death" rule before the game begins. In this embodiment, the player with fewer balls may, before playing a next round on a new circle, declare the next round the last round of the game. The strategy is for the declarer to make a sufficient number of one putt balls during the next round to maintain or gain the lead over the opponent. The score values for each player after the "Sudden Death" round are totaled for the final score.

In the further embodiments of "Never Short" and "Perfect Ball," an additional requirement is imposed on each putt for each ball in the game. In the "Never Short" embodiment, any ball putted short of the hole is removed from play. In effect, this embodiment of the game applies only to the first putt for a given ball. The second putt for a given ball must enter the cup for the ball to remain in play. Even though the second putt of a given ball is not short of the cup, and the ball does not enter the cup, the ball is removed from play. The "Never Short" embodiment is used for reinforcing acceleration through the putt, and results in all second putts coming back toward the cup.

In the "Perfect Ball" embodiment, any ball putted a distance greater than seventeen (17) inches past the cup is removed from play. In effect, this embodiment of the game also applies only to the first putt for a given ball. The second putt for a given ball must enter the cup for the ball to remain in play. Even though the second putt of a given ball is no greater than seventeen (17) inches past the cup, and the ball does not enter the cup, the ball is removed from play. The "Perfect Putt" embodiment is used for reinforcing the proper speed for the putt to maintain a good line to the cup. In a further embodiment of the game, "Never Short" and "Perfect Ball" are combined.

The descriptions above and the accompanying materials should be interpreted in the illustrative and not the limited sense. While the invention has been disclosed in connection with the preferred embodiment or embodiments thereof, it will be understood by those skilled in the art that various changes in form and details may be made therein without departing from the spirit and scope of the invention.

I claim:

1. A method for playing a putting game on a golf green surface having at least one cup therein, the method comprising the steps:

(a) providing each player a like plurality of golf balls, each ball having a unique feature for association with one player;

(b) in a first round, placing all balls on the circumference of a circle of a first radius with the cup at the circle center;

(c) putting, by each player, the balls having that player's associated unique feature until each ball enters the cup or each ball is putted twice;

(d) removing from play all balls putted twice and not entering the cup;

(e) providing a score value to each player for each ball remaining in play;

(f) in a second round, placing all balls remaining in play on the circumference of a circle of a second radius, greater than the first radius, with the cup at the circle center;

(g) putting, by each player, the balls having that player's associated unique feature until each ball enters the cup or each ball is putted twice;

(h) removing from play all balls putted twice and not entering the cup;

(i) providing a score value to each player for each ball remaining in play;

(j) in each subsequent round, repeating steps (f)–(i) with each circle radius greater than the prior round's circle radius, until all balls are out of play; and (k) totaling the score value for each player to determine a winner.

2. The method for playing a putting game on a golf green surface having at least one cup therein according to claim 1 wherein, the balls are placed in alternating sequence for all players around the circle circumference in each round.

3. The method for playing a putting game on a golf green surface having at least one cup therein according to claim 1 wherein, players putt in alternating sequence in each round.

4. The method for playing a putting game on a golf green surface having at least one cup therein according to claim 1 wherein, each player putts one ball consecutively until the ball enters the cup or is putted twice.

5. The method for playing a putting game on a golf green surface having at least one cup therein according to claim 1 wherein, the score value provided to each player for each ball remaining in play after each round is positively correlated with the circle radius of said each round.

6. The method for playing a putting game on a golf green surface having at least one cup therein according to claim 1 wherein, the score value for a ball entering the cup in one putt is five times the score value for a ball entering the cup in two putts.

7. The method for playing a putting game on a golf green surface having at least one cup therein according to claim 1 wherein, the score value for a ball entering the cup in one putt is two times the score value for a ball entering the cup in two putts.

8. The method for playing a putting game on a golf green surface having at least one cup therein according to claim 1, further including the step of designating, at an end of a round of play, the following round of play as a final round of play by a player with the fewer number of balls in play.

9. The method for playing a putting game on a golf green surface having at least one cup therein according to claim 1, further including the step of removing from play a ball putted short of the cup on a first putt.

10. The method for playing a putting game on a golf green surface having at least one cup therein according to claim 1, further including the step of removing from play a ball putted greater than seventeen inches beyond the cup on a first putt.

11. A method for playing a putting game on a golf green surface having at least one cup therein, the method comprising the steps:

(a) providing each player a like plurality of golf balls, each ball having a unique feature for association with one player;

(b) in a first round, placing all balls on the circumference of a circle of a first radius with the cup at the circle center;

(c) putting by each player the balls having that player's associated unique feature, each player putting one ball consecutively until each ball enters the cup or each ball is putted twice;

(d) removing from play all balls putted twice and not entering the cup;

(e) providing a score value to each player for each ball remaining in play, the score value positively correlated with the circle radius of the first round;

(f) in a second round, placing all balls remaining in play on the circumference of a circle of a second radius, greater than the first radius, with the cup at the circle center;

(g) putting by each player the balls having that player's associated unique feature, each player putting one ball consecutively until each ball enters the cup or each ball is putted twice;

(h) removing from play all balls putted twice and not entering the cup;

(i) providing a score value to each player for each ball remaining in play, the score value positively correlated with the circle radius of the second round;

(j) in each subsequent round, repeating steps (f)–(i) with each circle radius greater than the prior round's circle radius, until all balls are out of play; and (k) totaling the score value for each player to determine a winner.

12. The method for playing a putting game on a golf green surface having at least one cup therein according to claim 11 wherein, the balls are placed in alternating sequence for all players around the circle circumference in each round.

13. The method for playing a putting game on a golf green surface having at least one cup therein according to claim 11 wherein, players putt in alternating sequence in each round.

14. The method for playing a putting game on a golf green surface having at least one cup therein according to claim 11 wherein, the score value for a ball entering the cup in one putt is five times the score value for a ball entering the cup in two putts.

15. The method for playing a putting game on a golf green surface having at least one cup therein according to claim 11 wherein, the score value for a ball entering the cup in one putt is two times the score value for a ball entering the cup in two putts.

16. The method for playing a putting game on a golf green surface having at least one cup therein according to claim 11, further including the step of designating, at an end of a round of play, the following round of play as a final round of play by a player with the fewer number of balls in play.

17. The method for playing a putting game on a golf green surface having at least one cup therein according to claim 11, further including the step of removing from play a ball putted short of the cup on a first putt.

18. The method for playing a putting game on a golf green surface having at least one cup therein according to claim 11, further including the step of removing from play a ball putted greater than seventeen inches beyond the cup on a first putt.

19. A method for playing a putting game on a golf green surface having at least one cup therein, the method comprising the steps:

(a) providing each player a like plurality of golf balls, each ball having a unique feature for association with one player;

(b) in a first round, placing all balls in alternating sequence for all players on the circumference of a circle of a first radius with the cup at the circle center;

(c) in consecutive order around the circle, putting by each player the balls having that player's associated unique feature, each player putting one ball consecutively until each ball enters the cup or each ball is putted twice;

(d) removing from play all balls putted twice and not entering the cup;

(e) providing a score value to each player for each ball remaining in play, the score value positively correlated with the circle radius of the first round;

(f) in a second round, placing all balls remaining in play in alternating sequence for all players on the circumference of a circle of a second radius, greater than the first radius, with the cup at the circle center;

(g) in consecutive order around the circle, putting by each player the balls having that player's associated unique feature, each player putting one ball consecutively until each ball enters the cup or is putted twice;

(h) removing from play all balls putted twice and not entering the cup;

(i) providing a score value to each player for each ball remaining in play, the score value positively correlated with the circle radius of the second round;

(j) in each subsequent round, repeating steps (f)–(i) with each circle radius greater than the prior round's circle radius, until all balls are out of play; and (k) totaling the score value for each player to determine a winner.

20. The method for playing a putting game on a golf green surface having at least one cup therein according to claim

19, further including the step of designating, at an end of a round of play, the following round of play as a final round of play by a player with the fewer number of balls in play.

21. The method for playing a putting game on a golf green surface having at least one cup therein according to claim 19, further including the step of removing from play a ball putted short of the cup on a first putt.

22. The method for playing a putting game on a golf green surface having at least one cup therein according to claim 19, further including the step of removing from play a ball putted greater than seventeen inches beyond the cup on a first putt.

* * * * *